US008943951B2

(12) United States Patent
Maffeis

(10) Patent No.: US 8,943,951 B2
(45) Date of Patent: Feb. 3, 2015

(54) VACUUM-ACTUATED HANDLING DEVICE

(75) Inventor: Giuseppe Maffeis, Roncadelle (IT)

(73) Assignee: Gimatic S.p.A., Brescia (IT)

( * ) Notice: Subject to any disclaimer, the term of this patent is extended or adjusted under 35 U.S.C. 154(b) by 446 days.

(21) Appl. No.: 13/418,679

(22) Filed: Mar. 13, 2012

(65) Prior Publication Data

US 2012/0233994 A1 Sep. 20, 2012

(30) Foreign Application Priority Data

Mar. 14, 2011 (IT) ..... BS2011A0028

(51) Int. Cl.
*B65H 3/08* (2006.01)

(52) U.S. Cl.
CPC ..... *B65H 3/0816* (2013.01); *B65H 3/0883* (2013.01); *B65H 2401/15* (2013.01); *B65H 2402/343* (2013.01); *B65H 2402/542* (2013.01)
USPC ..... 92/171.1; 271/90

(58) Field of Classification Search
CPC ..... B65H 3/0816; B65H 3/0883; B65H 2402/343
USPC ..... 60/412; 92/171.1
See application file for complete search history.

(56) References Cited

U.S. PATENT DOCUMENTS

| | | | | | |
|---|---|---|---|---|---|
| 2,341,521 | A * | 2/1944 | Baker et al. | ..... | 271/103 |
| 3,702,698 | A * | 11/1972 | Schwebel | ..... | 271/103 |
| 3,834,558 | A * | 9/1974 | Bru | ..... | 414/627 |
| 4,534,549 | A * | 8/1985 | Eberle | ..... | 271/103 |
| 4,640,503 | A * | 2/1987 | Naumann | ..... | 271/103 |
| 5,059,088 | A * | 10/1991 | Klein | ..... | 414/627 |
| 6,612,633 | B1 * | 9/2003 | Tell | ..... | 294/186 |
| 7,014,185 | B2 * | 3/2006 | Ostreicher et al. | ..... | 271/90 |

FOREIGN PATENT DOCUMENTS

| | | | |
|---|---|---|---|
| FR | 2 564 811 | A1 | 11/1985 |
| GB | 967 058 | A | 8/1964 |

* cited by examiner

*Primary Examiner* — Thomas E Lazo
(74) *Attorney, Agent, or Firm* — McGlew and Tuttle, P.C.

(57) ABSTRACT

A vacuum—actuated handling device including, in the inner space (12) of a hollow body (11) with closed ends, a guide cylinder (13) defining an axial chamber (26) and, with the inner space, an annular compartment (25). In the chamber (26) a piston (14) movable between a rearward position adjacent to a first end and a forward position adjacent to a second end of said body (11) is accommodated. The piston is provided with an axially pierced rod (15), emerging from the second end of the body, carrying a gripping end sucker (27) and it is connected to a return spring (23) aiming to move the piston (14) to the rearward position. The piston (14) divides the chamber (26) in a first part of the chamber (a) adjacent to the first end and a second part of the chamber (b) on the side of said piston rod (15).

10 Claims, 4 Drawing Sheets

VACUUM-ACTUATED HANDLING DEVICE

FIELD OF THE INVENTION

The present invention refers to a pneumatic handling device, and it refers specifically to a vacuum—actuated prehensile device, suited for gripping and raising items to be taken in a place for the transfer and release in another workplaces.

In particular, as herein and hereinafter used, with the term "vacuum—activated" it is intended a device activated by a negative pneumatic pressure such that a pressure difference between two opposite faces of a piston working in a cylinder would induce the piston to axially move between an inactive position and an active position, and vice versa, nevertheless the term "vacuum" not meaning completely without pressure.

STATE OF THE ART

Prehensile devices, e.g. those afore mentioned which can be used in different industry field to transfer items from a workplace to another place in the occasion of different working or treating steps, are already known. For example, it is the case of paper and graphic industries where consecutive gripping, raising, transferring and releasing actions of paper sheets are required during the working, printing and sorting processes to be carried out in subsequent workplaces.

A prehensile device of the herein considered type and indicative of the state of the art is known, for example, from the document U.S. Pat. No. 6,612,633. It is a vacuum—actuated device comprising a movable piston in a chamber delimited by a cylinder and having a rod axially protruding from an end of said cylinder and carrying a gripping end sucker.

A cylinder part is connected to a vacuum pump. The piston can be moved together with the rod and the sucker from a rest rearward position to an active forward position through the air suction from a cylinder part by the vacuum pump, to which the sucker activation follows as the latter rests on the element to be taken and transferred. Then, the suction continuing, the piston moves back in the cylinder, urged also by a return spring, while the sucker is still active, retaining the taken element until the suction ends.

Then, the sucker is deactivated by releasing the element and the piston stays in the rearward position retained by the return spring.

However the vacuum—actuated prehensile device, as described in the afore said document, is relatively complex and expensive to be realized, it requires expensive mechanical operations for the execution of its components, it gives its functionality to the constructive and coupling precision of these components, involving extreme dimensional tolerances. Because these components are subjected to wear, nevertheless such a precision is missed in a short time and the operation reliability of the device declines therewith.

The document FR2 564 811 is indicative too of the state of the art, but the device described therewith comprises a single body and the sucking piston is housed and movable in a chamber obtained directly in said body and fed by a working fluid.

OBJECT AND SUMMARY OF THE INVENTION

Object of the present invention is to provide a vacuum—actuated handling device realized simply and cheaply, allowing to overcome the drawbacks of the known art and then to improve functionality, efficiency and duration of the device itself, furthermore to minimize the bulks.

Such an object is reached according to the invention with a handling device comprising essentially: an axially hollow body having an internal surface defining an inner space with a first and a second sealed ends; a guide cylinder inserted in said inner space and delimiting an axial chamber, said guide cylinder extending between said two sealed ends and defining a substantially annular compartment with the internal surface of said body; a piston movable in said cylindrical chamber between a rearward position adjacent to the first end and a forward position adjacent to said second end of said body; a rod integral and movable with said piston, guided and emerging from the second end of said body and carrying a gripping end sucker; a return spring connected to said rod and aiming to maintain the piston in said rearward position; and means for applying a pneumatic suction to the annular compartment and the axial chamber in said guide cylinder to induce in succession, firstly the movement of the piston from the rearward position to the forward position and to activate the sucker when it is leant on an element to be taken, afterwards the return of the piston in the rearward position with the aid of the return spring together with the sucker with the taken element, and then the deactivation of the sucker to release the taken element by an interruption of the suction.

Advantageously, the hollow body, the guide cylinder, the piston with the rod and the spring are coaxially connected one with each other, thereby also the annular compartment and the axial chamber defined by the guide cylinder are concentric. This component combination is particularly simple to be realized and it allows to minimize actually the whole bulk of the device with respect to other device with similar performance.

The first end of the inner space defined by the hollow body is closed by a head flange, whereas the second end of said inner space is closed by a base, preferably integral, flange, that is forming a single piece, with the guide cylinder.

Further in prosecution of said base flange a sleeve portion may be provided, as a whole too, acting as a guide for the piston rod.

In this way with the guide cylinder, the so integrated base flange and sleeve portion have the advantage of being able to handle a single piece, instead of more pieces, when the device has to be assembled. Further, the same single piece allows to facilitate the centering of the guide cylinder inside the hollow body, to close the second end of the inner space by the base flange and to constitute the guide means of the rod piston with the sleeve portion.

Then advantageously, the hollow body and the piston with the respective rod may be made of aluminum or alloy thereof: preferably the first is obtained by length cutting an extruded section, and the second by injection molding. On the other end, the head flange, the guide cylinder with the base flange and sleeve portion may be realized in thermoplastic material. In particular, then the guide cylinder may be realized with high precision degree without having to recourse to subsequent mechanical operations.

BRIEF DESCRIPTION OF THE DRAWINGS

The attached drawings show an embodiment of the prehensile device according to the invention, which will be hereinafter described more in detail for illustration and not limitative purposes. In said drawings.

DETAILED DESCRIPTION OF THE INVENTION

Figure 1:
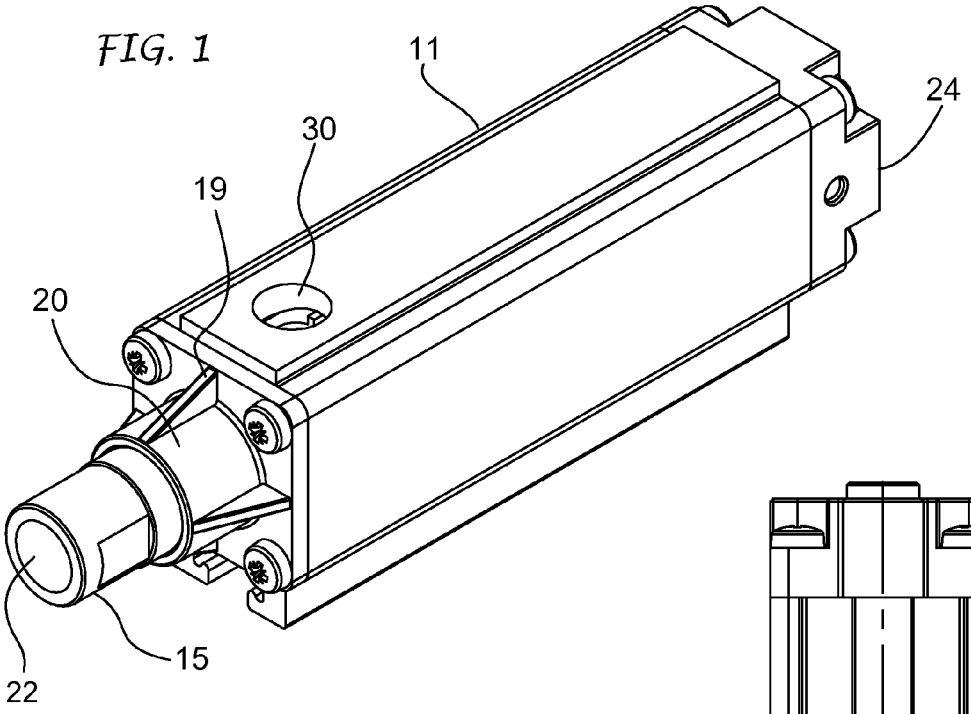
FIG. 1 shows a perspective view of the assembled device.

The represented device comprises a hollow outer body 11 having an internal surface delimiting a substantially cylindrical inner space 12, in which the guide cylinder 13 is inserted and accommodating a piston 14 in its turn, the latter having a rod piston 15, the whole being coaxial.

Advantageously, the outer body 11 may be obtained from an extruded section made of aluminum or alloys thereof; the guide cylinder 13 may be realized by molding with thermoplastic material; the piston 14 and the rod 15 may be made of aluminum or alloys thereof too as the body 11.

In particular, the hollow body 11 has externally a quadrilateral shape and sideways it has a longitudinal throat 16 and grooves or longitudinal holes 17 around the inner space 12. The guide cylinder 13 has longitudinal ribs 18 which are jutting sideways. In its end portion, it is provided with a base flange 19 and, in prosecution thereof, with a sleeve portion 20. The base flange 19 and the sleeve portion 20 are joined, preferably integral, with the guide cylinder.

The piston 14 is provided with gaskets 21 and with the rod it has an axial through hole 22 in which a return spring 23 extends, preferably of helical type.

The inner space 12 of the outer body 11 is closed, at one first end, the upper end in the drawings, by a head flange 24 and, at its opposite end, that is the lower end, by a base flange 19 integral with the guide cylinder 13. The flanges 24, 19 are both fastened to said outer body 11 by respective screws 24', 19' engaging into the groove or longitudinal holes 16 provided around the inner space 12.

Figure 4:
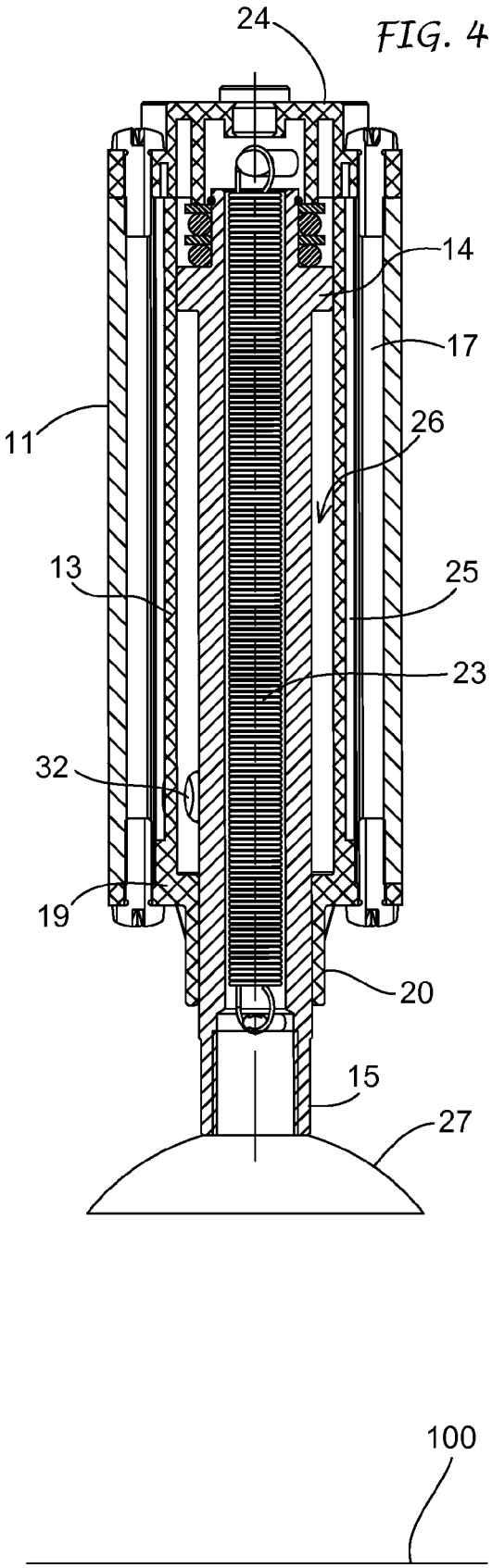
FIG. 4 shows a longitudinal section of the device in the position of FIG. 3.
Figure 6:
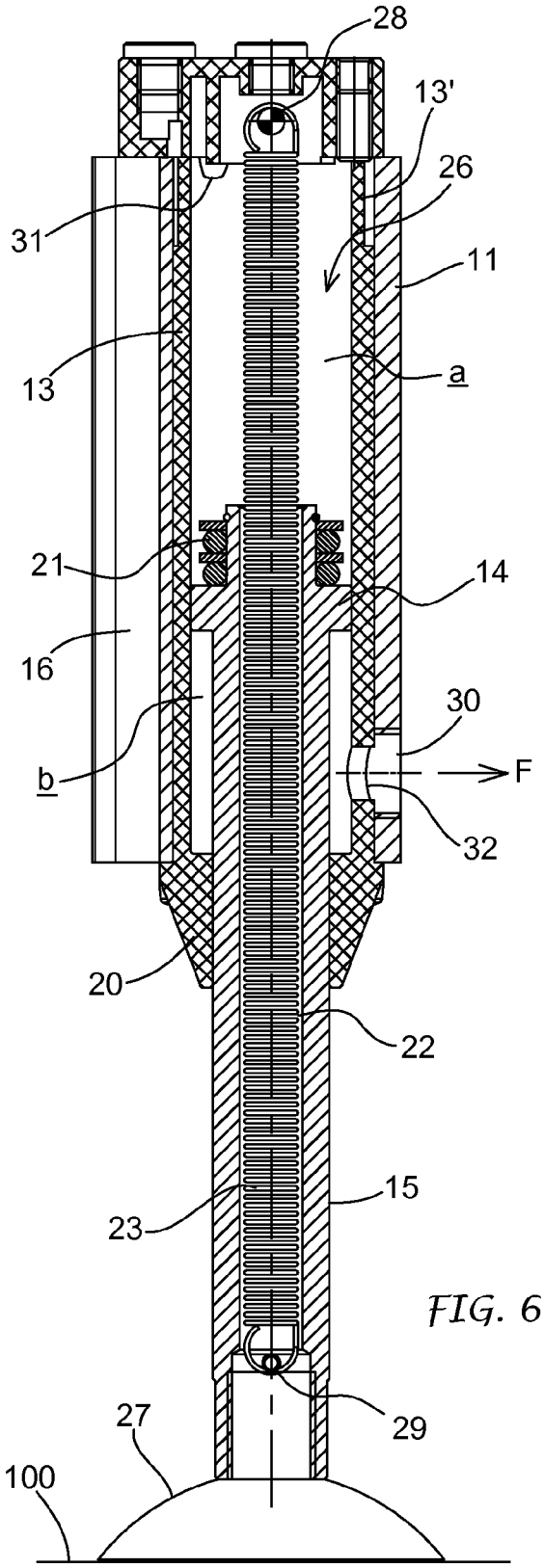
FIG. 6 shows a longitudinal section of the device in the position of FIG. 5.

In particular, and as it is shown in the drawings—FIGS. 4 and 6—the guide cylinder 13 is inserted into the outer body 11 with a top end 13' facing towards the head flange 24 and with the sleeve portion 20 integral with the base flange 19 facing axially outwardly of said body. The guide cylinder 13 is centered in the outer body 11 by respective side ribs 18 in such a way to delimit an annular compartment 25 with the inner surface of said body 11. Further, the guide cylinder 13 delimits a chamber 26 in its inside, and the piston 14 is slidingly accommodated in this chamber with its rod 15 extending and guided in the sleeve portion 20, and passing therein, in prosecution of the base flange 19 of the guide cylinder 13.

The piston 14 is movable between a rearward position in which it is closer to the head flange 24, and a forward position in which it is near the base flange 19 integral with the guide cylinder 13. The cylinder rod 15 extends beyond the sleeve portion 20 and it carries a gripping sucker 27 at its free end in communication with the axial through hole 22. The return spring 23 has one of its end constrained to the head flange 24 by a pin 28 and an opposite end constrained to the piston rod 15 by another pin 29—FIG. 6.

As a whole, when the piston 14 is assembled it divides the afore said chamber 26 inside the guide cylinder 13 in two parts: a first chamber part a between the piston and the head portion 24 and a second chamber part b at the side of the rod 15, that is to say around said rod between the piston 14 and the base flange 19 integral with the guide cylinder 13.

The outer body has, preferably next to the base flange 19, that is flush with the second part b of the inner chamber 22, a suction hole 30 in communication with the annular compartment 25 between the outer body 11 and the guide cylinder 13. The annular chamber 25 communicates in its turn with the first chamber portion a through a first radial opening 31 in the top part 13 of the guide cylinder 13 and with the second chamber part b through a second radial opening 32 obtained in the wall of said guide cylinder 13, preferably, but not necessarily, in front of the suction hole 30. On the other hand, the first part of the chamber a is in communication with the axial hole 22 of the piston rod 15 and through this with the gripping sucker 27.

A suction source, that is a vacuum pump, even if not represented, is connected to this suction hole 30, the former being intended to create a pneumatic depression inside the annular compartment 25 and the two chamber parts a, b defined by the piston 14 inside the guide cylinder 13 to actuate the device and at the same time to activate the gripping sucker 27. In particular, the openings 31 will be dimensioned and/or provided with flow regulators so that to create a pressure difference in the two chambers a and b at opposite sides of the piston 14.

When assembled, the afore described device may be coupled with and fastened to a mover arm—not represented—for its spatial displacements between a first pick up place of an element 100 to be handled and at least one more release place of such an element. The device may be fastened to the mover arm, for example, at and/or through the side throat 16 of the outer body 11.

Figure 3:
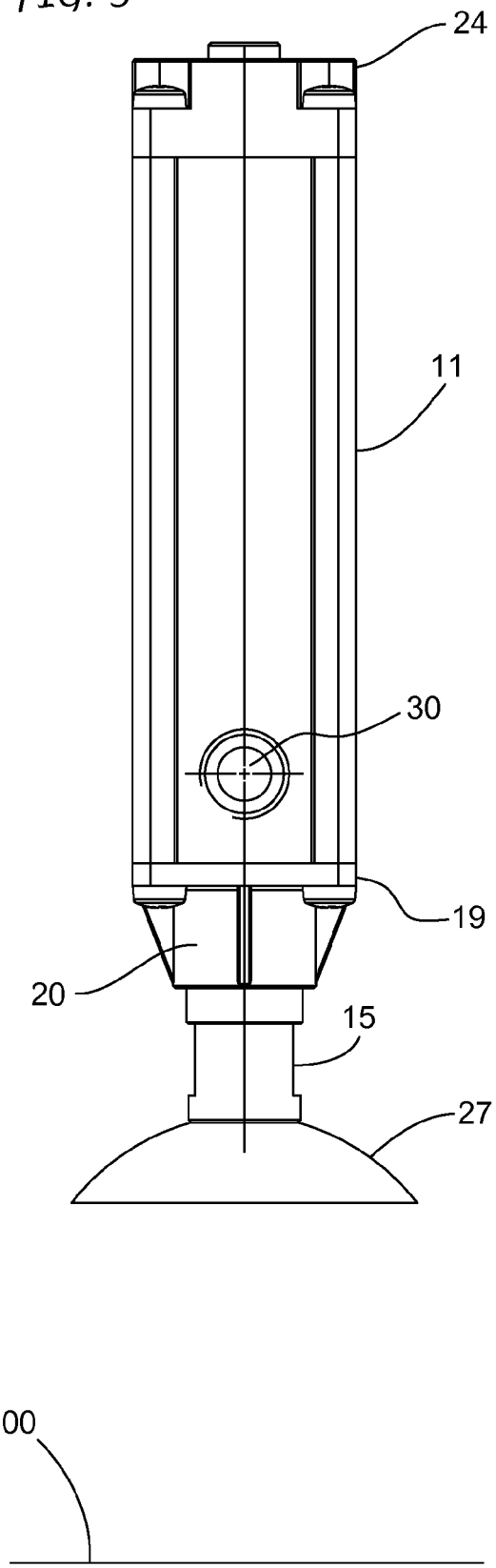
FIG. 3 shows a front view of the device with the piston in the rearward position.

The device stays in the rest state as shown in FIGS. 3 and 4, until a pneumatic suction is applied by means of the vacuum pump. In that position the piston 14 with the respective rod 15 remain active, withdrawn in the guide cylinder 13 by means of the return spring 23 connected thereto. In this same position the gripping sucker 27 is not operating and it is kept at a distance from the element 100 to be taken and handled from a workplace.

On the contrary, the suction application to the device, with the meaning of evacuating the air mainly from the second part b, precisely from the side of the rod 15 of the piston 14 of the chamber 26 in the guide cylinder 13 in the direction of the arrow F in FIG. 6, induces the piston to move from the rearward position to the forward position. In fact, in the part b of the chamber a depression is thus created, whereas in the part a of the chamber the atmospheric pressure remains because it communicates with the outside through the axial hole 22 of the rod 14. The pressure difference between the two parts of the chamber a and b then causes an advancing movement of the piston 14 with the rod 15 and the sucker 27 towards the element to be taken 100, at the same time tensioning the return spring 23.

Figure 7:
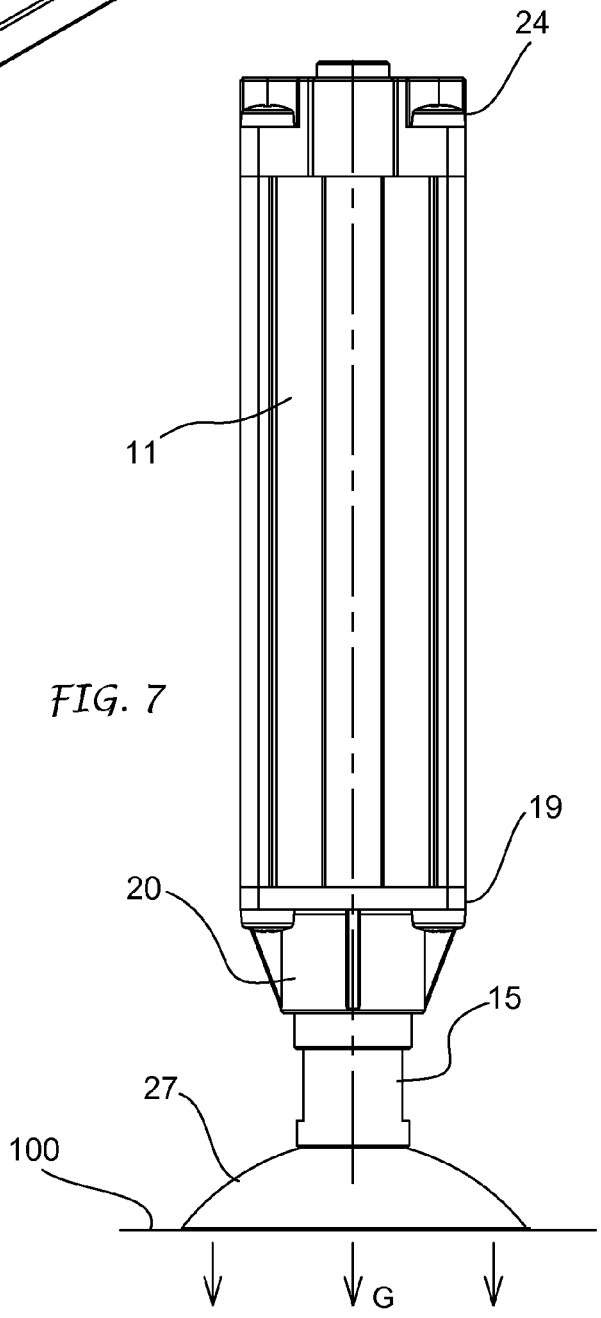
FIG. 7 shows a side view of the device in the gripping position of an element to be handled.
Figure 2:
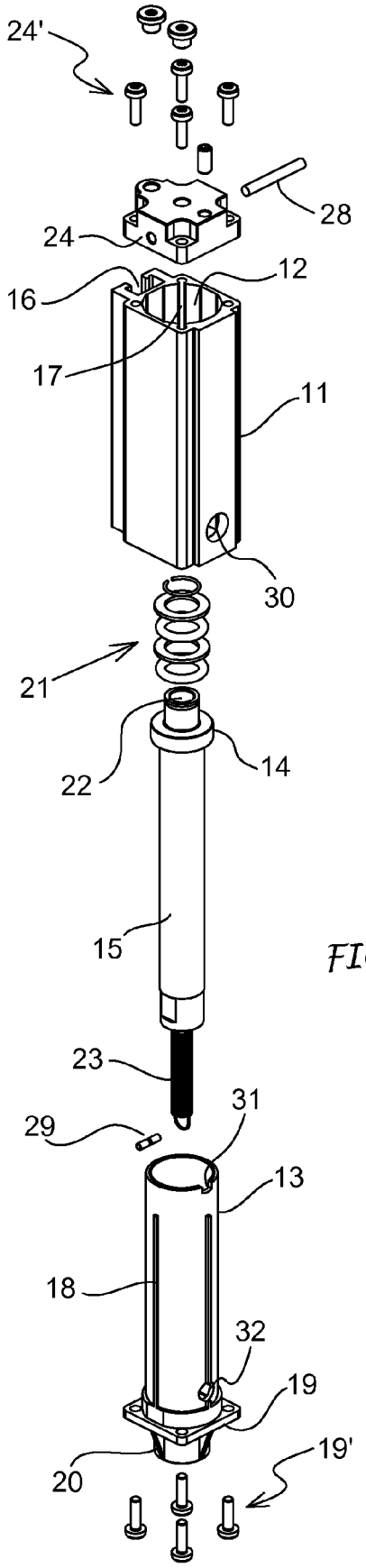
FIG. 2 shows an exploded view of device components.
Figure 5:
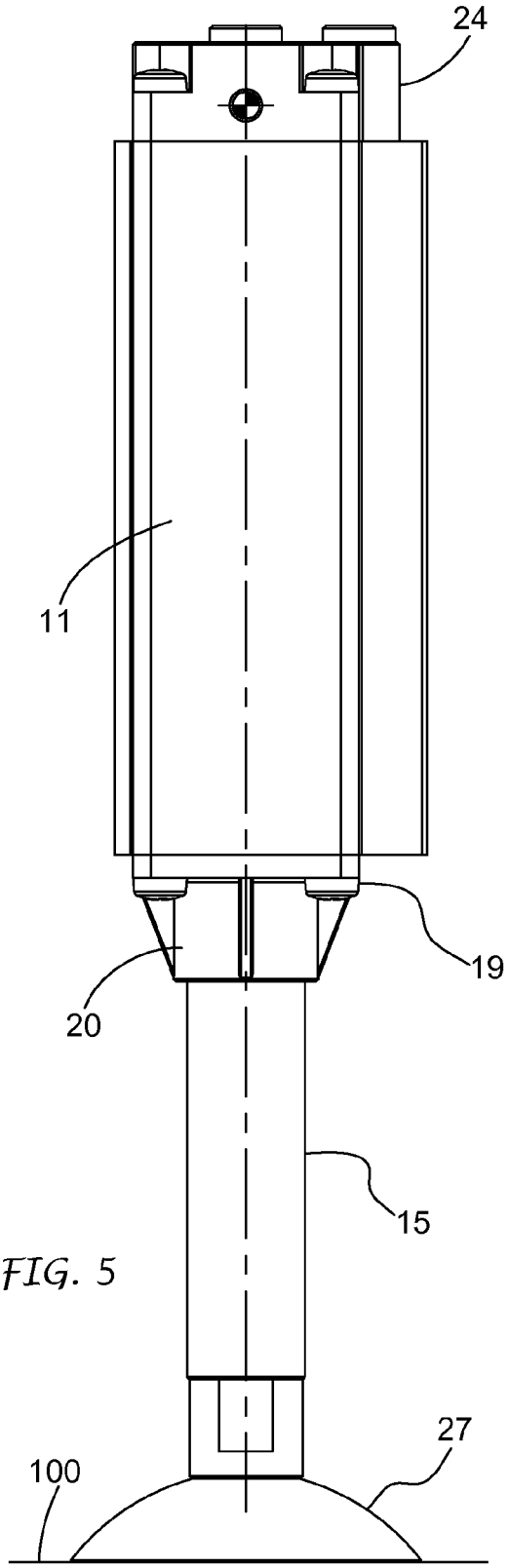
FIG. 5 shows a front view of the device with the piston in the forward position.

Then, going on with the suction, as the sucker 27 rests on the element to be taken 100, as shown in FIGS. 5 and 6, the axial hole 22 of the rod 15 of the piston 14 is obstructed. Then the depression propagates also in the part a of the chamber through the annular compartment 26 and the top opening 31 of the guide cylinder 13 and then through the axial hole 22 of the rod 15 from said chamber to the sucker 27, activating it. Then the depression in the two parts of the chamber 26 tends to balance, whereby the return spring 23 determines the displacement of the piston 14 to the rearward position at the same time withdrawing the rod and the sucker 27 with the taken element 100. The device may then by displaced by means of the arm to which it is engaged in another workplace where the suction action is stopped so that to release the element in this other place according to the arrows G in FIG. 7.

The invention claimed is:

1. A vacuum—actuated handling device, comprising:

an axially hollow body having an internal surface defining an inner space with a first end and a second end sealed by respective head and base flanges;

a piston movable between a rearward position adjacent to the first end and a forward position adjacent to said second end of said body;

a rod integral and movable with said piston, guided and emerging from the second end of said body and carrying a gripping end sucker;

a return spring connected to said rod and aiming to maintain said piston in said rearward position; and a suction pneumatic means for controlling the movements of said piston between said rearward and forward position, wherein:

a guide cylinder is inserted in the inner space and is retained between the two close ends of said hollow body, said guide cylinder delimiting an axial chamber and defining a substantially annular compartment with the internal surface of said body;

said piston is accommodated and movable in said axial chamber;

said pneumatic means is provided for applying a pneumatic suction to the annular compartment and the axial chamber in said guide cylinder to induce in succession, firstly the movement of the piston with the corresponding rod and sucker from the rearward position to the forward position and to activate said sucker when said sucker is leant on an element to be taken, afterwards the return of the piston with the corresponding rod in the rearward position with the aid of said return spring and together with the sucker with the taken element, and then the deactivation of the sucker to release the taken element by an interruption of the suction.

2. A vacuum—actuated handling device according to claim 1, wherein the hollow body, the guide cylinder, the piston with the corresponding rod and return spring are coaxially connected one with each other, and the annular compartment and the axial chamber defined by the guide cylinder are concentric.

3. A vacuum—actuated handling device according to claim 2, wherein the guide cylinder has side ribs for centering into the inner space of said hollow body and for delimiting said annular compartment therewith.

4. A vacuum—actuated handling device according to claim 2, wherein the first end of the inner space defined by the hollow body is closed by a head flange and the second end of said inner space is closed by a base flange integral with the guide cylinder and having a sleeve portion intended to receive a guide the rod of the piston.

5. A vacuum—actuated handling device according to claim 1, wherein the first end of the inner space defined by the hollow body is closed by a head flange and the second end of said inner space is closed by a base flange integral with the guide cylinder and having a sleeve portion intended to receive a guide the rod of the piston.

6. A vacuum—actuated handling device according to claim 5, wherein the guide cylinder has side ribs for centering into the inner space of said hollow body and for delimiting said annular compartment therewith.

7. A vacuum—actuated handling device according to claim 1, wherein the piston divides the chamber in the guide cylinder in a first part of the chamber between the piston and the head flange and a second part of the chamber on the side of said rod between the piston and the base flange of the guide cylinder, and said second chamber is directly communicating with the pneumatic suction means, whereas said second chamber is in fluidic communication with said suction means through said annular compartment and at least one passage at a top end of said guide cylinder and with the axial hole of the piston with the corresponding rod when the sucker is on.

8. A vacuum—actuated handling device according to claim 1, wherein said pneumatic suction means includes a vacuum pump directly or indirectly connected with the device.

9. A vacuum—actuated handling device according to claim 1, wherein the hollow body and the piston with the corresponding rod are made of aluminum or alloys thereof, wherein the body is obtained from an extruded section and the piston with the corresponding rod are obtained by injection molding.

10. A vacuum—actuated handling device according to claim 1, wherein the head flange and the guide cylinder complete with the base flange and the sleeve portion are made of thermoplastic material, obtained by molding.

* * * * *